United States Patent [19]

Yokoe et al.

[11] Patent Number: 4,519,549

[45] Date of Patent: May 28, 1985

[54] ELECTROSTATIC COATING PROCESS AND APPARATUS FOR USE THEREIN

[75] Inventors: Sadao Yokoe; Seimei Abe; Shoichi Wakata; Satosi Endou, all of Yokohama; Kazuyoshi Onozawa, Sayama, all of Japan

[73] Assignee: Trinity Industrial Corporation, Tokyo, Japan

[21] Appl. No.: 426,091

[22] Filed: Sep. 28, 1982

[30] Foreign Application Priority Data

Oct. 16, 1981 [JP] Japan ..... 56-164276

[51] Int. Cl.[3] ..... B05B 5/00

[52] U.S. Cl. ..... 239/703; 118/626; 239/700; 239/701; 239/702; 427/30; 427/31

[58] Field of Search ..... 427/31, 30; 118/626; 239/700, 701, 702, 703

[56] References Cited

U.S. PATENT DOCUMENTS 4,148,932 4/1979 Tada et al. ..... 427/31

4,423,840 1/1984 Coeling ..... 239/3

*Primary Examiner*—Michael R. Lusignan

*Assistant Examiner*—Kenneth Jaconetty

*Attorney, Agent, or Firm*—Sherman & Shalloway

[57] ABSTRACT

An electrostatic coating process which comprises feeding a liquid paint in thin film form toward the circumferential edge of a high-velocity rotating member having a high voltage applied thereto along the inner circumferential surface thereof and atomizing the paint from the circumferential edge of the high-velocity rotating member; characterized in that a number of cuts are formed on the circumferential edge, and a stream of the paint flowing forwardly substantially in the axial direction of the high-velocity rotating member is converted at said circumferential edge into a number of diametrically outwardly flowing divided paint streams and simultaneously atomized and discharged. Preferably, the paint is fed to the inner circumferential surface of the rotating member through an annular paint flow passage having knurled grooves formed over its entire outer circumferential surface.

3 Claims, 9 Drawing Figures

1
2
5
7
8
9
10
11
12
13
15
16

1
2
3
4
5
6
7
8
11
14
15

ELECTROSTATIC COATING PROCESS AND APPARATUS FOR USE THEREIN

BACKGROUND OF THE INVENTION

1. Field of the Invention

This invention relates to an electrostatic coating process and an apparatus for use therein. More specifically, it relates to an improvement in a process and an apparatus for performing electrostatic coating by atomizing a liquid paint in the electrically charged state from a high-velocity rotating member having a high voltage applied thereto.

2. Description of the Prior Art

For electrostatically atomizing a liquid paint, a method has previously been known which comprises feeding a liquid paint in thin film form toward the circumferential edge of a rotating member along the inner circumferential surface thereof and discharging the paint in atomized form from a knife-like tip provided on the circumferential edge of the rotating member. This electrostatic atomizing method, however, is not entirely satisfactory. When the viscosity of the liquid paint is relatively low and the rotating speed of the rotating member is as low as several hundred to several thousand revolutions per minute or the amount of the paint discharged is relatively small, the resulting mist of the paint will assume a satisfactory state. But when the viscosity of the paint is relatively high, or the amount of the paint discharged is increased by increasing the rotating speed of the rotating member, the paint tends to leave the knife-like edge in an irregular liquid film form, and this tendency leads to the defect that the mist of the paint includes air and the resultant coated film formed on an article contains bubbles.

On the other hand, the use of a liquid paint having the highest possible viscosity by decreasing the amount of the solvent is very desirable from the standpoint of the saving of the cost of the solvent and the cost of coating and baking, the prevention of air pollution, the expediting of the coating treatment, etc.

An attempt has already been made to solve the problem of air bubble entrainment which arises when a liquid paint having a high viscosity is used and the rotating speed of an atomizing rotating member is increased. For example, Japanese Patent Publication No. 41825/1980 discloses a method for feeding a liquid paint as a thin film-like stream toward a circular releasing edge having a knife edge-like sectional shape in a rotating atomizing device, in which the paint is divided into a number of branched streams and fed to the circular releasing edge by providing in the peripheral edge portion of a paint-guiding surface of the rotating atomizing device a number of shallow depressed grooves extending in the advancing direction of the paint stream and reaching the outside end of the aforesaid peripheral edge portion. According to this known method, the formation of a liquid film extending outwardly beyond the releasing end edge will be inhibited when the amount of the liquid paint discharged per unit time is relatively low. However, when the amount of the liquid paint discharged is relatively large, the size of the resulting paint droplets will become large, or air bubble entrainment will be liable to occur.

SUMMARY OF THE INVENTION

It is an object of this invention therefore to provide an electrostatic coating process and apparatus wherein a liquid paint having a high viscosity can be atomized into fine droplets without entrainment of air bubbles, etc. even when it is atomized at a high speed of discharging per unit time.

Another object of this invention is to provide an electrostatic coating process and apparatus wherein atomization of a liquid paint is effected to a much finer size than in the prior art when the amount of the paint discharged is the same, and wherein the amount of a liquid paint discharged can be made much larger than in the prior art when atomization is effected to provide paint particles of the same size.

Still another object of this invention is to provide a process and apparatus wherein by changing a stream of a paint flowing substantially axially forwardly along the inner circumferential surface of a rotating member to a number of diametrically outwardly flowing divided streams at a non-knife edge-like releasing end edge of the rotating member, the paint can be atomized into fine particles even when the amount of the paint discharged is increased.

Yet another object of this invention is to provide a rotating atomizing device for electrostatic coating, wherein even when the rotating member is rotated at a high speed, a paint can be fed in uniform distribution over the entire periphery of the releasing edge of the rotating member and consequently, an atomization pattern having no unevenness nor deviation and being substantially close to a true circle can be formed.

A further object of this invention is to provide a rotating atomizing device for electrostatic coating, in which the uniform distribution of a liquid paint is possible by a relatively simple structure, and a paint distributing mechanism does not undergo blocking even by the stopping of the coating operation or the inclusion of foreign matter in the paint, and which is easy to clean, maintain and build.

In one aspect, the present invention provides an electrostatic coating process which comprises feeding a liquid paint in thin film form toward the circumferential edge of a high-velocity rotating member having a high voltage applied thereto along the inner circumferential surface thereof and atomizing the paint from the circumferential edge of the high-velocity rotating member; characterized in that a number of cuts are formed on the circumferential edge, and a stream of the paint flowing forwardly substantially in the axial direction of the high-velocity rotating member is converted at said circumferential edge into a number of diametrically outwardly flowing divided paint streams and simultaneously atomized and discharged.

In another aspect, the present invention provides an electrostatic coating apparatus comprising a rotating member having an inner circumferential surface for guiding a liquid paint in thin film form toward its end and a circumferential edge for atomizing and discharging the paint, a mechanism for driving the rotating member at high speed and a power supply for applying a high voltage to the rotating member; characterized in that the circumferential edge has a number of cuts regularly arranged radially at small intervals, the valleys of the cuts are each located within a plane substantially at right angles to the axis of the rotating member, the inner circumferential surface of the rotating member forms a smooth introducing surface inwardly of the valleys of the cuts, and the introducing surface approaches the valleys of the cuts at an inclination angle of within ±15° to the axial direction.

In still another aspect, the present invention provides a high-velocity rotating atomizing device for electrostatic coating, said device comprising a circumferential edge for atomizing and discharging a liquid paint, an inner circumferential surface for guiding the paint in thin film form to the circumferential edge, an annular paint reservoir for storing the paint and an annular paint flow passage connecting the paint reservoir to the inner circumferential surface; characterized in that the circumferential edge has a number of cuts regularly arranged radially at small intervals, the valleys of the cuts are each located within a plane substantially at right angles to the axis of the rotating member, the inner circumferential surface forms a smooth introducing surface inwardly of the valleys of the cuts, and the introducing surface approaches the valleys of the cuts at an inclination angle of within ±15° to the axial direction. Preferably, in this high-velocity rotating atomizing device, the outer circumferential surface of the annular paint flow passage is provided with knurled grooves for distributing the paint uniformly.

The present invention is described below in greater detail with reference to the accompanying drawings in which:

DETAILED DESCRIPTION OF THE PREFERRED EMBODIMENTS

Figure 1:
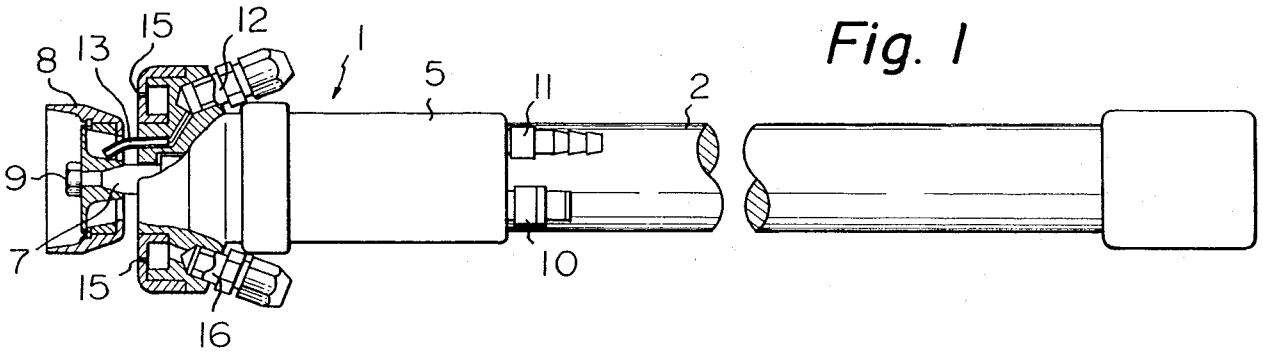
FIG. 1 is a top plan view, partly in section, of the electrostatic coating apparatus of this invention in its entirety.
Figure 2:
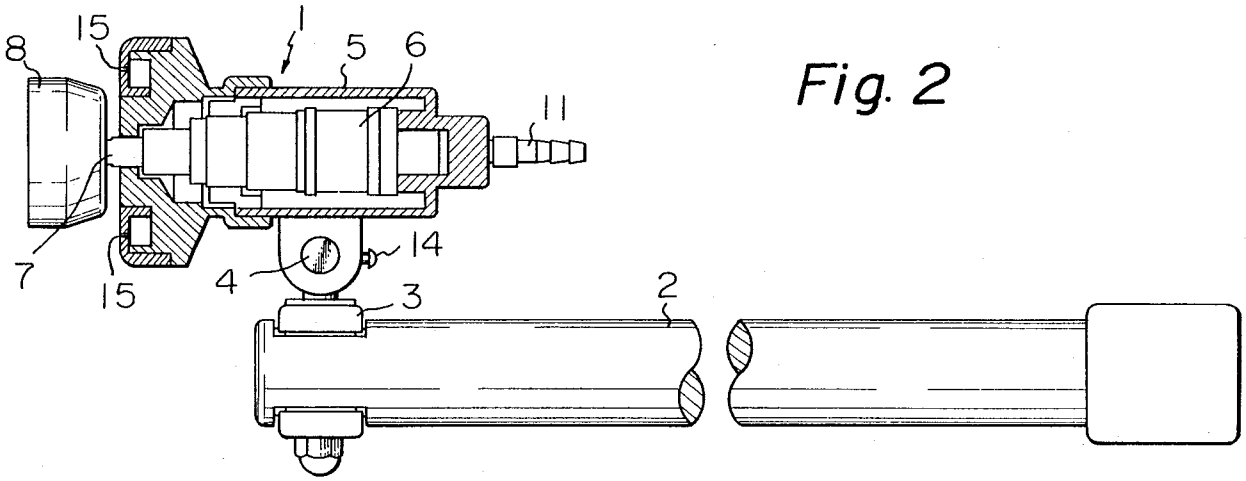
FIG. 2 is a side sectional view of the apparatus shown in FIG. 1.

With reference to FIGS. 1 and 2 showing the arrangement of the electrostatic coating apparatus of this invention in its entirety, a main body 1 of the coating apparatus is provided rotatably about a fulcrum 4 by means of a bracket 3 provided at the end of an electrically insulating supporting rod 2 disposed for up-and-down movement by a suitable lifting device (not shown).

The main body 1 of the coating apparatus has an air motor 6 disposed within a housing 5. A rotating member (cup) 8 for atomizing is fixed by means of a clamping means such as a nut 9 to the end of a rotating shaft 7 of the air motor 6. The main body 1 of this coating apparatus also includes an air feed inlet 10 for rotating the air motor 6 at a high speed and an exhaust outlet 11 for discharging the air. A feed inlet 12 for a liquid paint is also provided in the main body 1 of the coating apparatus. The liquid paint is fed into the rotating member 8 from the feed inlet 12 through a paint feed pipe 13 extending to the rotating member 8 through the inside of the main body 1. A high voltage cable connecting terminal 14 is also provided in the main body 1 of the coating apparatus so that a high voltage from a high voltage generating device (not shown) is applied to the main body 1 of the coating apparatus and therefore, to the rotating member 8 through a cable (not shown). A number of jet holes 15 for jetting a shaping air, i.e. air for pattern formation, are arranged annularly on that side of the housing 5 to which the rotating member 8 is attached, and connected to an air feed inlet 16.

Figure 3:
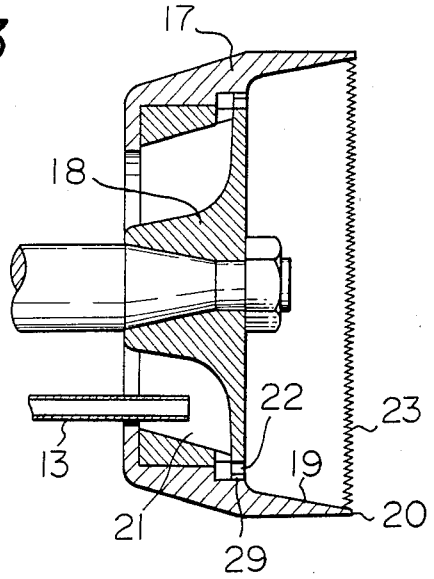
FIG. 3 is a side sectional view of a rotating member for atomization.
Figure 4:
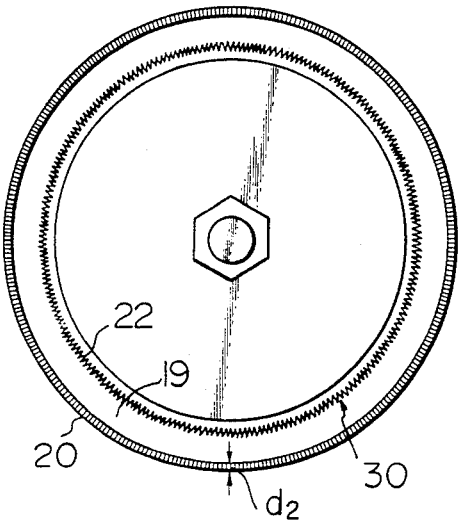
FIG. 4 is a front elevation of the rotating member shown in FIG. 3.

In FIGS. 3 and 4 which show the rotating member (cup) 8 on an enlarged scale, the rotating member 8 is of the shape of a cup consisting of a metallic outside member 17 and a metallic inside member 18 which are fitted to each other. The rotating member 8 has an inner circumferential surface 19 for guiding a liquid paint in thin film form toward the edge of the rotating member 8 and a circumferential edge 20 for atomizing and discharging the paint. Furthermore, there is formed in the rotating member 8 an annular paint reservoir 21 for storing the paint fed from the paint feed pipe 13 and then uniformly feeding the paint over the entire inner circumferential surface 19. The paint reservoir 21 and the inner circumferential surface 19 are caused to communicate with each other through annular slits 22 provided at small intervals between the outside member 17 and the inside member 18.

A high voltage is applied to the rotating member 8 through the cable connecting terminal 14, and the air motor 6 is driven by air supplied through the air feed inlet 10. As a result, the rotating member 8 is rotated at a high speed, of for example, 8,000 to 30,000 rpm. The liquid paint is fed to the paint reservoir 21 within the rotating member 8 through the paint feed inlet 12 and the paint feed pipe 13, and through the annular slits 22, is supplied in the form of a uniform thin film over the entire inner circumferential surface 19 of the rotating member 8. The paint on the inner circumferential surface 19 flows substantially forwardly in the axial direction of the rotating member 8 and is discharged in the atomized state from the circumferential edge 20.

Figure 5:
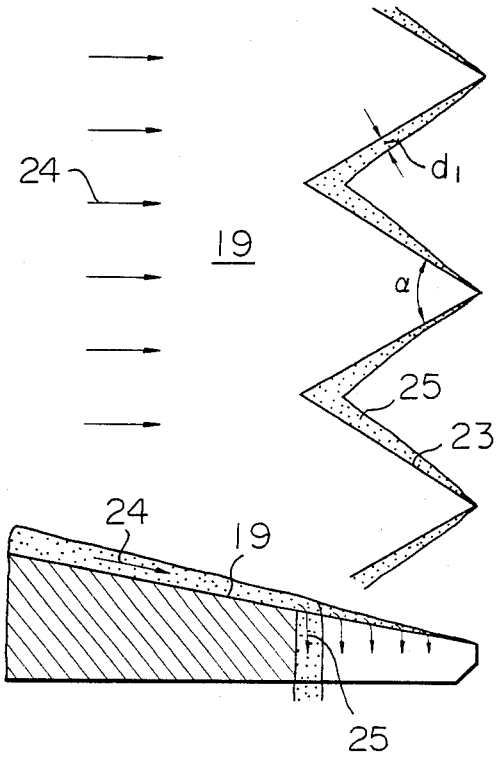
FIG. 5 is a diagram for explaining the principle of this invention.

The important feature of the present invention is that at least that portion of the inner circumferential surface 19 near the circumferential edge 20 is inclined at an angle substantially parallel to the rotating axis of the rotating member 8, and that a number of cuts 23 are provided on the circumferential edge 20, and as shown in FIG. 5, a stream 24 of the paint directed forwardly substantially in the axial direction of the rotating member along the inner circumferential surface 19 is converted to a number of radially outwardly flowing divided paint streams 25 at the circumferential edge 20. According to the prior art, a paint is fed to the knife edge-like tip of the rotating member as a number of divided branched streams. In contrast, according to this invention, the paint is fed in the form of a continuous thin film until it reaches the circumferential edge 20, and at the circumferential edge 20, the thin film-like paint stream flowing forwardly substantially in the axial direction of the rotating member 8 is converted to a number of diametrically outwardly flowing divided streams 25. In the present invention, the conversion of the substantially axially forwardly flowing stream into the diametrically outwardly flowing streams is effected by the centrifugal force generated by the rotation of the rotating member at very high speed. In addition, the division of the stream into the streams 25 is easily done by providing a number of cuts 23 at the circumferential edge 20.

According to this invention, marked advantages over the prior art can be achieved by providing the cuts 23 in the circumferential edge 20 and dividing the paint stream flowing forwardly substantially in the axial direction of the rotating member 8 into the diametrically outwardly flowing streams 25 at the circumferential edge 20 having the cuts 23. When many cuts 23 are provided in the circumferential edge 20, the length of contact of the circumferential edge with air, i.e. the length of the paint releasing end edge, can be made much longer than when the circumferential edge 20 is composed of a circumferential knife edge. In the embodiment shown in FIG. 5, the cuts 23 are in the form of saw teeth. For example, let the angle ($\alpha$) of a tooth be 60°, the length of contact of the circumferential edge with air is twice as large as that in the case of the knife edge-like end. When this angle ($\alpha$) is smaller than 60°, the aforesaid contact length becomes more than 2 times. Thus, according to this invention, the average thickness dl of the film at the circumferential edge contacting the air can be made much smaller than in the case of using the knife edge-like tip if it is assumed that the amount of the paint supplied per unit time is the same. Consequently, the atomized particles of the paint can be extremely fine in size. To put it the other way round, when the paint is atomized into particles having the same size as in the prior art, the present invention makes it possible to increase the amount of the paint supplied per unit time as compared with the prior art, and to effectively prevent the entrainment of air bubbles during atomization.

In addition, according to this invention, the thickness of the paint is reduced at the circumferential edge contacting the air and the paint stream is converted to streams having unevenness which are directed diametrically and extend along the cuts 23. Accordingly, the invention brings about the advantage that even when the paint has a high viscosity, it is atomized rapidly into fine particles when going past the circumferential edge 20 diametrically outwardly.

Furthermore, by the structural characteristic of the electrode wherein the edge 20 is provided with many cuts 23 and as a result of the paint being atomized into fine particles, the atomized particles of the paint are highly charged electrically, and the efficiency of paint deposition is increased.

Figure 6:
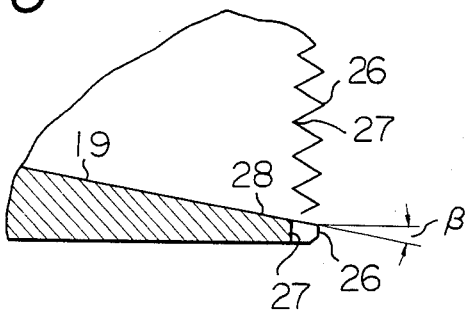
FIGS. 6, 7-A and 7-B are sectional views, partly enlarged, of the circumferential edge of a rotating member.

The cuts 23 provided in the circumferential edge 20 of the rotating member 8 extend radially at small intervals $d_2$ in the diametrically outward direction, as clearly shown in FIG. 4. The ridges 26 and valleys 27 of the cuts 23 are arranged so that each is located within a plane substantially at right angles to the axis of the rotating member 8, as shown in FIG. 6. The inner circumferential surface 19 of the rotating member 8 forms a smooth introducing surface 28 inwardly of the valleys 27, and the smooth introducing surface 28 approaches the valleys 27 of the cuts 23 at an inclination angle ($\beta$) of within ±15°, preferably within ±10°, to the axial direction.

By providing the cuts 23 and the inner circumferential surface 19 in this positional relationship, it is possible to distribute and introduce uniformly the thin film-like stream of the paint to the cuts 23 and convert it at the cuts 23 accurately into diametrically outwardly flowing divided streams. For example, if the inclination angle ($\beta$) of the introducing surface 28 is larger than +15°, the paint tends to flow as an irregular liquid film beyond the circumferential edge 20, and is difficult to divide into diametrically outwardly flowing streams along the cuts 23.

Figure 7:
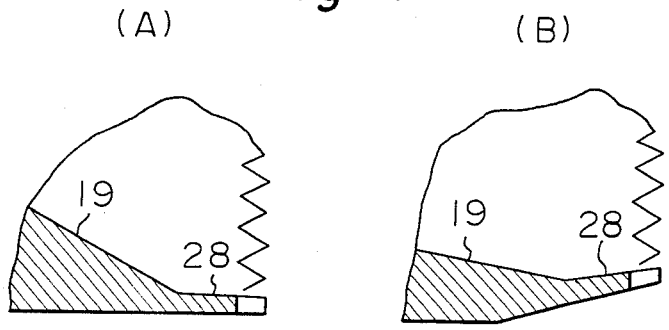

In the embodiment shown in FIG. 6, the introducing surface 28 is provided at a predetermined inclination angle forming the same plane as the other part of the inner circumferential surface 19. If desired, the introducing surface 28 may be connected at an inclination angle of nearly zero to the end of the other part of the inner circumferential surface 19 having a large inclination angle, as shown in FIG. 7-A. Or as shown in FIG. 7-B, an introducing surface 28 having a negative inclination angle may be connected to the end of the other part of the inner circumferential surface having a positive inclination angle.

In the embodiments shown in the attached drawings, the regularly arranged cuts 23 are all in the form of a saw tooth. The saw-toothed cuts are especially desirable for the purpose of effectively dividing the film-like stream of paint at the ridges 26 and also of increasing the length of contact of the edge with air.

It is preferred for the objects of this invention that the pitch (P) of each of the saw-toothed cuts 23 be in the range of 0.1 to 1.5 mm, especially 0.2 to 0.8 mm, and the angle ($\alpha$) of each tooth be in the range of 30° to 120°, especially 45° to 90°. Furthermore, the interval ($d_2$) of the cuts 23 in the diametrical direction, that is the thickness of the edge, is generally in the range of 0.5 to 5 mm, especially 1 to 3 mm. This is preferred in order to maintain the mechanical strength of the rotating member and the discharge electric current within proper ranges or to make finer atomization possible.

In the present invention, the cuts may be of any shape in addition to being of the shape a saw tooth so long as they are regularly provided in large number on the circumferential edge. For example, they may be of a rectangular currugated shape, a trapezoidal corrugated shape, a U-shape, a V-shape, etc.

Another important feature of the present invention is based on the fact the when knurled grooves 30 are provided over the entire outer circumferential surface 29 of the annular flow passage 22 as shown in FIGS. 3 and 4, the knurled grooves 30 act also as a distributing and smoothening mechanism for uniformly distributing the paint over the entire annular flow passage 22 and smoothening the paint film, and even when the rotating member is rotated at a high speed, the paint can be fed in uniform distribution over the entire circumference of the paint releasing circumferential edge 20 of the rotating member 8.

The paint supplied to the rotating member 8 from the paint feed pipe 13 first fills the reservoir 21, goes through the annular flow passage 22, and overflows onto the inner circumferential surface 19. When the rotating speed of the rotating member 8 is high, the non-uniformity of the overflowing stream of paint from the annular flow passage 22 tends to result in the non-uniform atomization of the paint from the circumferential edge 20. Specifically, when the rotating speed of the rotating member is relatively low, a phenomenon of deviation in the atomization pattern is hardly observed for the following reasons.

(a) Since the centrifugal force acting on the paint in the annular flow passage 22 is small and therefore the speed of flowing of the paint is relatively small, a sufficient amount of the paint is stored over the entire circumference of the paint reservoir 21, and consequently, the paint overflows uniformly from the entire circumference of the annular flow passage 22.

(b) Even when the overflowing of the paint from the annular flow passage 22 becomes non-uniform, the paint which has overflowed onto the inner circumferential surface 19 is rendered uniform during flowing along the inner circumferential surface 19 and then is released from the circumferential edge 20 as a uniform flow. Hence, the flowing of the paint on the inner circumferential surface 19 is made uniform.

In contrast, when the rotating speed of the rotating member 8 is as high as 10,000 rpm for example, the non-uniformity of the overflowing of the paint at the annular flow passage immediately results in deviation of disturbance of the atomization pattern for the following reasons.

(A) Since the centrifugal force acting on the paint in the annular flow passage 22 is large and therefore the speed of flowing of the paint at this portion is also large, the paint flows out from the annular flow passage 22 before a sufficient amount of the paint is stored over the entire circumference of the paint reservoir 21. Consequently, the overflowing stream of paint from the annular flow passage 22 becomes non-uniform.

(B) When the rotating member 8 is rotated at high speed, the paint which has overflowed onto the inner circumferential surface 19 from the annular flow passage 22 scarcely flows along the inner circumferential surface 19, but flows straight toward the edge of the rotating member 8 in the diametrical direction or the axial direction of the rotating member 8. Hence, the flowing of the paint stream at the inner circumferential surface 19 cannot be expected to be made uniform. Generally, this nonuniformity of the overflowing stream or the disturbance of the atomization pattern develops the tendency that the amount of the paint flowing or discharged gradually increases from the paint feed position toward the rotating direction of the rotating member 8, and after reaching its maximum, gradually decreases.

Figure 8:
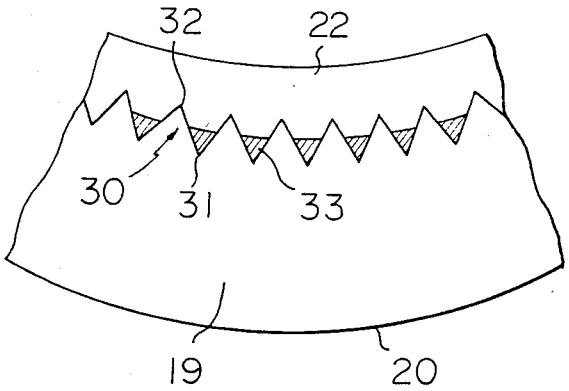
FIG. 8 is an enlarged view of knurled grooves.

As shown on an enlarged scale in FIG. 8, the knurled grooves 30 formed on the outer circumferential surface 29 of the annular flow passage 22 are comprised of alternately arranged V-shaped flow control orifices 31 and inverted V-shaped barriers 32. Because of this arrangement, the knurled grooves 30 simultaneously perform an action of a dam to permit flow-out of a small amount of the paint but inhibit flow-out of a large amount of the paint and a flow control action. Thus, the grooves 30 are considered to smoothen the liquid surface at the annular flow passage 22 uniformly and make the flow rate of the paint uniform throughout the entire circumference of the annular flow passage 22.

According to this invention, the effect of distributing the paint uniformly over the inner circumferential surface of the rotating member 8 can be achieved by a simple structure wherein knurled grooves are provided on the outer circumferential surface of the annular flow passage 22. The formation of the knurled grooves is easy, and the knurled grooves do not undergo blockage even when the coating operation is stopped or foreign matter comes into the paint. Furthermore, these knurled grooves are easy to clean or maintain.

It is especially desirable that the knurled grooves formed on the outer circumferential surface of the annular flow passage should be of a saw-toothed shape as shown in the drawings in order that they perform the aforesaid action. It is preferred for the objects of this invention that the knurled grooves 30 have a pitch in the range of 0.1 to 3 mm, especially 0.2 to 1.5 mm, and a depth in the range of 0.1 to 3 mm, especially 0.2 to 1.5 mm. Needless to say, so long as these knurled grooves are provided regularly in large number over the entire circumferential surface of the annular flow passage, they may also assume any other desired shape, such as a trapezoidal corrugated shape, a gear-like shape, a rectangular corrugated shape, or a U-shape.

It should also be understood that the rotating member 8 can be of any desired shape such as a shallow cup-like shape, or a flat dish-like shape in addition to the deep-drawn cup-like shape as shown in the drawings.

The electrostatic coating process of this invention is useful in performing coating while rotating the rotating member at a high speed of, for example 5,000 to 50,000 rpm, especially 8,000 to 30,000 rpm. The voltage to be applied to the rotating member can be properly selected from the range of 20 to 160 KV, especially from 40 to 120 KV.

All paints heretofore used in this type of electrostatic coating can be used in this invention. For example, the present invention can be advantageously applied to the coating of organic solvent-base paints such as epoxy-type paints, phenol-type paints, melamine-type paints, and acrylic paints, and water-base paints, particularly highly viscous paints containing a small amount of solvent, for example highly viscous paints having a viscosity, determined by Ford cup #4, of at least 30 seconds (at least 75 centipoises).

The amount of the paint discharged considerably varies depending upon the diameter of the paint releasing edge of the rotating member, the size of the cuts, etc. According to this invention, a beautiful paint film without film defects can be formed by electrostatic coating of the paint having the aforesaid viscosity at a rate of as large as 500 cc/min. by using a rotating member having an edge outside diameter of 60 mm.

What is claimed is:

1. In a high-velocity rotating atomizing device for electrostatic coating, said device comprising a circumferential edge for atomizing and discharging a liquid paint, an inner circumferential surface for guiding the paint in thin film form to the circumferential edge, an annular paint reservoir for storing the paint and an annular paint flow passage connecting the annular paint reservoir to the inner circumferential surface; the improvement wherein the circumferential edge has a number of cuts regularly arranged radially at small intervals and comprised of alternating ridges and valleys, wherein the valleys of the cuts are each located within a plane substantially at right angles to the axis of the rotating member, the inner circumferential surface forms a smooth introducing surface inwardly of the valleys of the cuts, and the introducing surface approaches the valleys of the cuts at an inclination angle of within ±15° to the axial direction and wherein knurled grooves are formed on the entire outer circumferential surface of the annular paint flow passage, the knurled grooves having a pitch of 0.1 to 3 mm and a depth of 0.1 to 3 mm.

2. The apparatus of claim 1 wherein the cuts are of saw-toothed shape.

3. The apparatus of claim 1 wherein the cuts have a pitch of 0.1 to 1.5 mm, a tooth angle of 30° to 120°, and a edge thickness of 0.5 to 5 mm.

* * * * *